US005363760A

United States Patent [19]

Lindenmueller et al.

[11] Patent Number: 5,363,760

[45] Date of Patent: * Nov. 15, 1994

[54] ROTOR UNIT FOR A POSTAGE METER MACHINE

[75] Inventors: Johann Lindenmueller, Malching; Alois Wagner, Olching, both of Germany

[73] Assignee: Ascom Hasler AG, Bern, Switzerland

[ * ] Notice: The portion of the term of this patent subsequent to Sep. 5, 2010 has been disclaimed.

[21] Appl. No.: 634,218

[22] PCT Filed: Jun. 21, 1990

[86] PCT No.: PCT/CH90/00149

§ 371 Date: Feb. 4, 1991

§ 102(e) Date: Feb. 4, 1991

[87] PCT Pub. No.: WO90/16047

PCT Pub. Date: Dec. 27, 1990

[30] Foreign Application Priority Data

Jun. 22, 1989 [CH] Switzerland ..... 02320/89

[51] Int. Cl.[5] ..... B41L 47/46

[52] U.S. Cl. ..... 101/91; 101/110; 235/130 R

[58] Field of Search ..... 101/74, 91, 110, 106; 235/130 R, 132 R

[56] References Cited

U.S. PATENT DOCUMENTS

| | | | |
|---|---|---|---|
| 3,890,491 | 6/1975 | Malavazos et al. | 101/91 |
| 3,918,361 | 11/1975 | Malavazos | 235/132 R |
| 3,965,815 | 6/1976 | Lupkas et al. | 101/110 |
| 4,448,122 | 5/1984 | Holland-Letz | 101/110 |
| 4,520,725 | 6/1985 | Haug | 101/91 |
| 4,649,814 | 3/1987 | Sette | 101/110 |
| 4,702,164 | 9/1987 | Muller | 101/91 |
| 4,723,486 | 2/1988 | Le Meur et al. | 101/110 |
| 4,739,701 | 4/1988 | Haug | 101/91 |
| 4,771,688 | 9/1988 | Muller | 101/110 |
| 4,774,881 | 10/1988 | Schubert | 101/91 |

FOREIGN PATENT DOCUMENTS

| | | |
|---|---|---|
| 0111321 | 6/1984 | European Pat. Off. . |
| 0217576 | 4/1987 | European Pat. Off. . |
| 160586 | 7/1931 | Germany . |
| 2102346 | 2/1983 | United Kingdom . |

OTHER PUBLICATIONS

Hasler Mitteilungen [Hasler Review] 37 (Apr. 1978), No. 1 pp. 1–7 (R. Grunig: Die Frankiermaschine Hasler Mail Master [The Hasler Mail Master Postage Meter Machine].

*Primary Examiner*—Eugene H. Eickholt
*Attorney, Agent, or Firm*—McAulay Fisher Nissen Goldberg & Kiel

[57] ABSTRACT

A rotor unit comprises a rotor cylinder which is fastened to a shaft and is rotatably supported via an external bearing. A gear motor is arranged in the interior, which gear motor drives a first double gear wheel in both rotating directions (a, b) via its power take-off shaft and a pinion. The double gear wheel is supported on a disk and a bearing plate in a freewheel bearing and engages with a second double gear wheel. In one rotating direction (b), the freewheel bearing locks the toothed wheel, so that the latter, rigidly together with the disk, is carried along by the pinion. In this way, the second double gear wheel engages serially with one intermediate gear in each instance, wherein every such engagement is exactly positioned by means of a ball catch. In the other rotating direction (a), the motor in each instance turns a number wheel via the aforementioned gears and accordingly sets e.g. one digit of the postage meter machine's value stamp. All digits of the value stamp, date stamp and other stamps are adjusted automatically by means of alternate rotation in the two rotating directions (a, b). The motor receives its commands, via sliding contacts, from a control unit arranged outside the rotor cylinder.

11 Claims, 8 Drawing Sheets

ROTOR UNIT FOR A POSTAGE METER MACHINE

FIELD OF THE INVENTION

The invention is directed to a rotor unit for a postage meter machine and to a method for operating such rotor unit.

BACKGROUND OF THE INVENTION

Postage meter machines are commercially available in a number of variations. A printing rotor which comprises a postage value stamp on its cylindrical surface is standard in these machines. The numerals on this value stamp are selectively movable and are set by the user according to the postage required in each case. A counter or meter amount storage, in which all meter amounts and postage amounts are added up so that they can be accounted for by the authorized postal authority, is coupled with the postage value stamp. In addition, a place and date stamp, an advertizing stamp and possibly other stamps are arranged on the cylinder surface of the printing rotor and can be set as desired.

In metering, the printing rotor rolls over the postal item to be metered, e.g. a letter, making a complete revolution and in so doing imprints the various stamps one after the other. Such a postage meter machine is described for example in *Hasler Mitteilungen* [Hasler Review] 37 (Apr. 1978), No. 1, pages 1–7 (R. Grünig: Die Frankiermaschine Hasler Mailmaster [The Hasler Mailmaster Postage Meter Machine]).

In the past, the postage value stamp was generally adjusted via toothed racks which are supported in the shaft of the printing rotor so as to be displaceable in the longitudinal direction of this shaft and constitute part of a working connection between the value stamp and the meter amount storage. Patent CH 160 586 is referred to in this regard by way of example.

A newer postage meter machine is known from U.S. Pat. No. 4,702,164 in which the postage amounts are set without the aid of toothed racks of the aforementioned type. This postage meter machine has a printing rotor which is supported on its shaft so as to be rotatable. The printing rotor and the adjusting means therein can be connected in three different ways by means of a positioning rod, which is displaceable in the longitudinal direction, and by other means. Accordingly, three different modes of operation can be adjusted. In the "value select" or "digit select" operating mode, a printing wheel is rotated into a desired adjusting position while the rotor remains stationary, thereby setting a number to be imprinted. In the "print wheel select" (bank select) operating mode, the next print wheel to be set is mechanically coupled with the shaft while the rotor again remains stationary. Finally, in the third operating mode, "print", the rotor is rigidly coupled with the shaft in the conventional sense and the desired metering is effected in that the rotor rolls over the postal item running through it.

The shafts of all of the aforementioned postage meter machines are relatively complicated, and accordingly costly parts which can generally be produced only by chip-removing machining.

SUMMARY OF THE INVENTION

A primary object of the invention is to provide a postage meter machine in which the shaft of the printing rotor is constructed in a more simple manner. Further, the remaining construction should be capable of being manufactured more easily and, thus, more cheaply.

In accordance with the present invention, there is provided a rotor unit for a postage-meter machine, comprising a rotatingly mounted rotor cylinder, at least one stamp, located on the rotor cylinder, with which are associated a number of adjustable number wheels, setting elements which can be mechanically coupled to the number wheels and by means of which these wheels can be set according to requirements of a user, a drive shaft that can be rotated in opposite directions and which acts together with the setting elements, a drive motor which drives the drive shaft either directly or via step-down gearing, locking means which lock against movement all numeral wheels whose setting is not to be changed at the particular time, and connecting means which, depending on the direction of rotation of the setting shaft, act in such a way that when the shaft rotates in one direction, the shaft can be coupled with any desired number wheel, whereas when the shaft rotates in the opposite direction, a coupled number wheel can be brought into the desired setting position.

For a better understanding of the present invention, reference is made to the following description and accompanying drawings while the scope of the invention will be pointed out in the appended claims.

DETAILED DESCRIPTION OF THE INVENTION AND PREFERRED EMBODIMENTS

Figure 1:
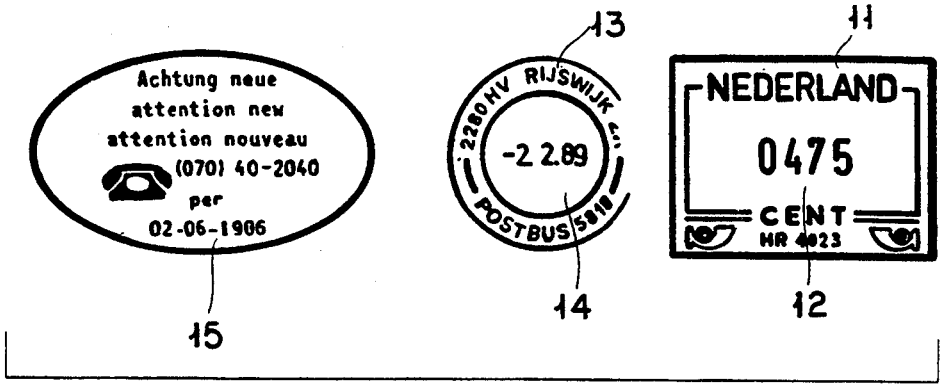
FIG. 1 illustrates an example of a stamp imprint.

FIG. 1 shows an example of a stamp imprint by a postage meter machine. A four-digit amount is indicated in the value stamp 11, in this example, the number 0475, meaning "postage amount 4 guilders, 75 cents". A second round stamp 13 is imprinted to the left of this, bearing the place name at the edge and the date 14 on the inside. The third imprint is an informative text 15 which is contained on an interchangeable printing block and has no postal significance.

Figure 2:
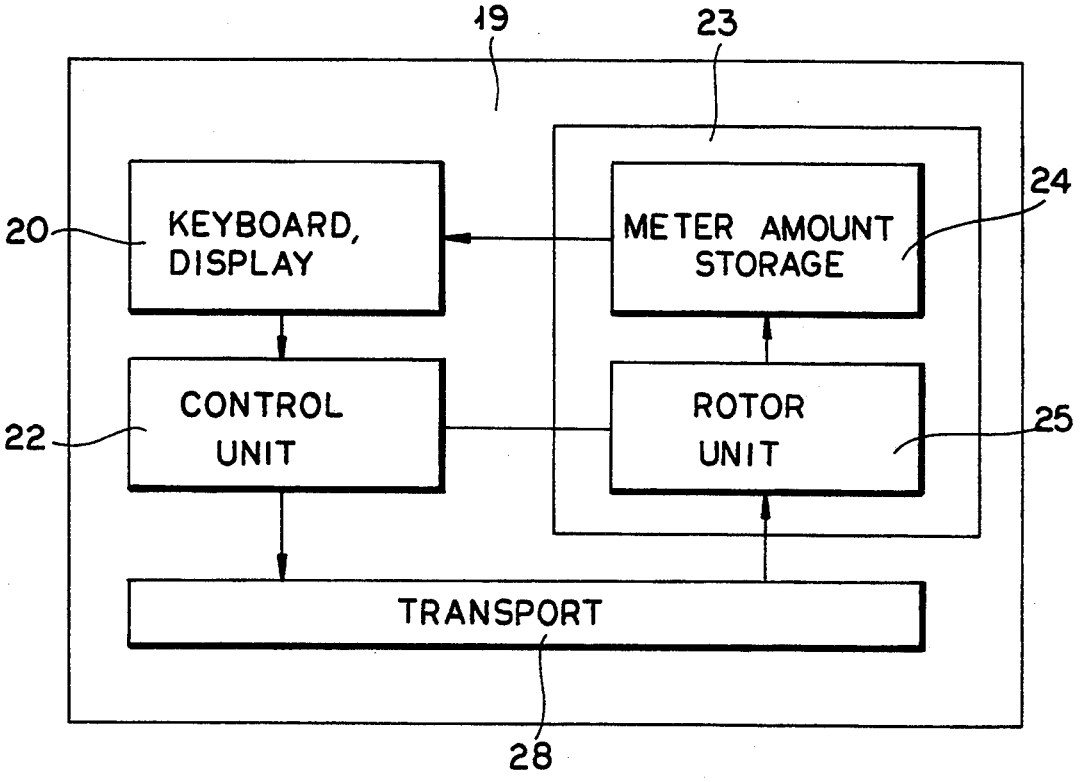
FIG. 2 illustrates a block diagram of a postage meter machine.

FIG. 2 shows a rough block diagram of a postage meter machine 19. It comprises a keyboard and display unit 20, control unit 22, a meter amount storage 24, a rotor unit 25 and a transporting unit 28. A metering process for the postage, e.g. 4 guilders, 75 cents, is entered via the keyboard and display unit 20. The control unit 22 ensures that this postage amount is correctly set in the rotor. The control unit further controls the transporting of the postal item to be metered, e.g. a letter, to the rotor which rolls over the item passing by it and in so doing prints the postage amount on it. The metering operation and the meter value or postage amount which is used are stored in the meter amount storage 24 and indicated on the display. The postage amount can also be input automatically rather than manually, e.g. via a connected postal scale with postage calculator.

The meter amount storage (prepayment meter) 24 and rotor unit 25 form a specially secured combination which ensures that each metered value can also be accounted for by the authorized authority, in particular the national postal authority. This is indicated in the drawing by border 23.

Figure 3:
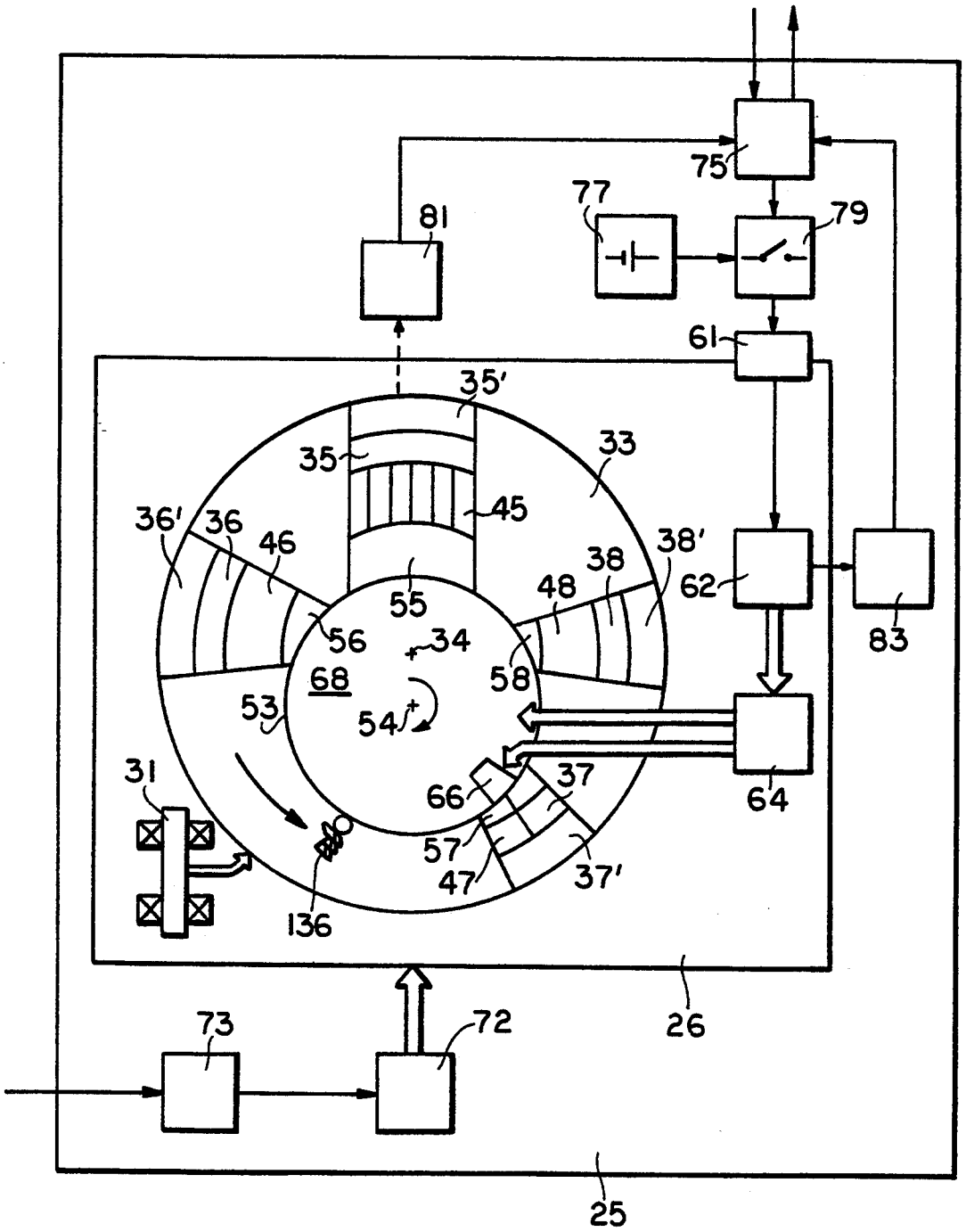
FIG. 3 illustrates a block diagram of a rotor unit.

FIG. 3 is a block diagram of the rotor unit 25 which is composed of electrical and mechanical parts. The electrical working connections are indicated by single arrows and the mechanical working connections by double arrows. Rotor unit 25 comprises the actual rotor 26 and the units arranged outside of this rotor 26.

Rotor 26 comprises a unilaterally and rotatably supported shaft 31 to which rotor cylinder 33 is centrically flanged. The latter is considerably larger in diameter than shaft 31 and contains various stamps 35 to 38 within it. These stamps are arranged in such a way that their curved printing areas 35' to 38' form a part of the cylindrical surface of the rotor cylinder 33. The stamp 35 is a postage value stamp showing, e.g. the postage amount to four decimal places. This stamp is obligatory for all postage meter machines. The next stamp is a date and place stamp 36 with an adjustable date. The third stamp is an advertizing stamp 37 with no postal significance, which can be folded out of the way and exchanged, and the fourth stamp is a postal identification stamp 38 for indicating the mailing class, e.g. "registered". Stamps 37 and 38 are purely optional and are used at the discretion of the user of the postage meter machine. Additional stamps are readily conceivable, provided there is sufficient space in the rotor cylinder 33.

An adjusting or setting element 45 to 48 is assigned to each stamp 35 to 38. These adjusting elements are either toothed wheels which mesh with the printing elements of the stamps 35 to 38 (e.g. the number wheels of the value stamp 35) or toothed levers, by means of which e.g. the advertizing stamp 37 can be lowered or raised. Each of the adjusting elements 45 to 48 has a gearing area 55 to 58. These areas are located on a common circle whose center 54 does not necessarily lie on the geometric axis 34 of the rotor cylinder 33.

Further, a small drive motor 62, a clutch arrangement 64, a gearing element 66, and a bearing element 8 for the latter 66 are arranged in the rotor cylinder 33. Motor 62 drives either gearing element 66 or its bearing element 68, as desired, via the clutch arrangement 64. Bearing element 68 may be designed e.g. as a disk which is rotatably supported in the center 54 of the circle 53. Motor 62 is supplied with current via contacts 61.

The following elements of the rotor unit 25 are arranged outside rotor 26: an additional drive motor 72 with associated control 73 for driving the rotor 26, an additional control 75, current source 77, control switch 79, setting sensor 81 and rotation sensor 83. These units serve to control drive motor 62 and to control and monitor the adjusting processes in rotor 26.

Figure 4:
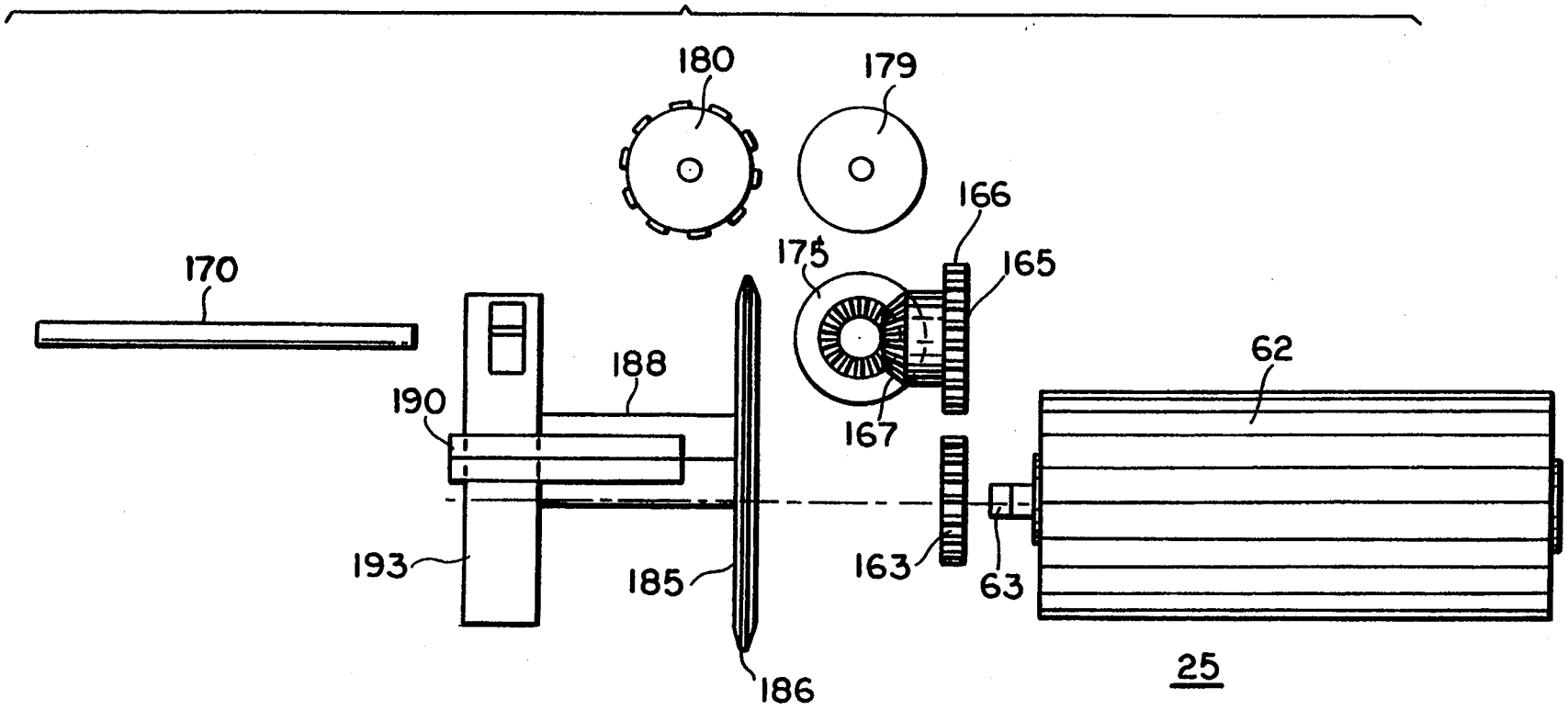
FIG. 4 is an exploded view of parts inside a printing rotor.

FIG. 4 shows, as an example of a first concrete embodiment, an exploded view of a portion of the structural component parts of rotor 26 which are shown schematically in FIG. 3. The cylindrical drive motor 62 has, on its power take-off shaft 63, a pinion 163 in the form of a spur gear. The pinion 163 engages with a first double gear wheel 165 comprising a spur gear 166 and a bevel gear 167. This double gear wheel 165 is rigidly fastened to a shaft 170.

The first double gear wheel 165 engages, via its bevel gear 167, with a second double gear wheel 175 which is preferably identical to the first (165). This second double gear wheel 175 engages, via its spur gear, with an intermediate gear 179, and the latter 179 in turn engages with a number wheel 180.

The second double gear wheel 175 is supported in a slot-shaped or pocket-shaped cut out portion of a disk 185 transversely relative to the axle 170 in such a way that its spur gear just reaches the edge 186 of the disk. The edge 186 of this disk 185 is bevelled in a wedge-shaped manner corresponding to the shape of the teeth of the spur gear of the second double gear wheel 175. In this way, one tooth of the toothed wheel 175 aligns in each instance with disk edge 186 without substantial intermediate space, i.e. edge 186, together with the tooth, forms a practically closed circle.

Disk 185 is rigidly held at one end of a hollow shaft 188. A bearing plate 193 is arranged, also rigidly, at the other end of the shaft 188. A freewheel bearing 171, in which shaft 170 is supported, is arranged in bearing plate 193. Due to this type of bearing and assembly, the first double gear wheel 165 is rotatable in one direction only. Finally, the hollow shaft 188 is rotatably supported on a fixed axle 190.

Figure 5:
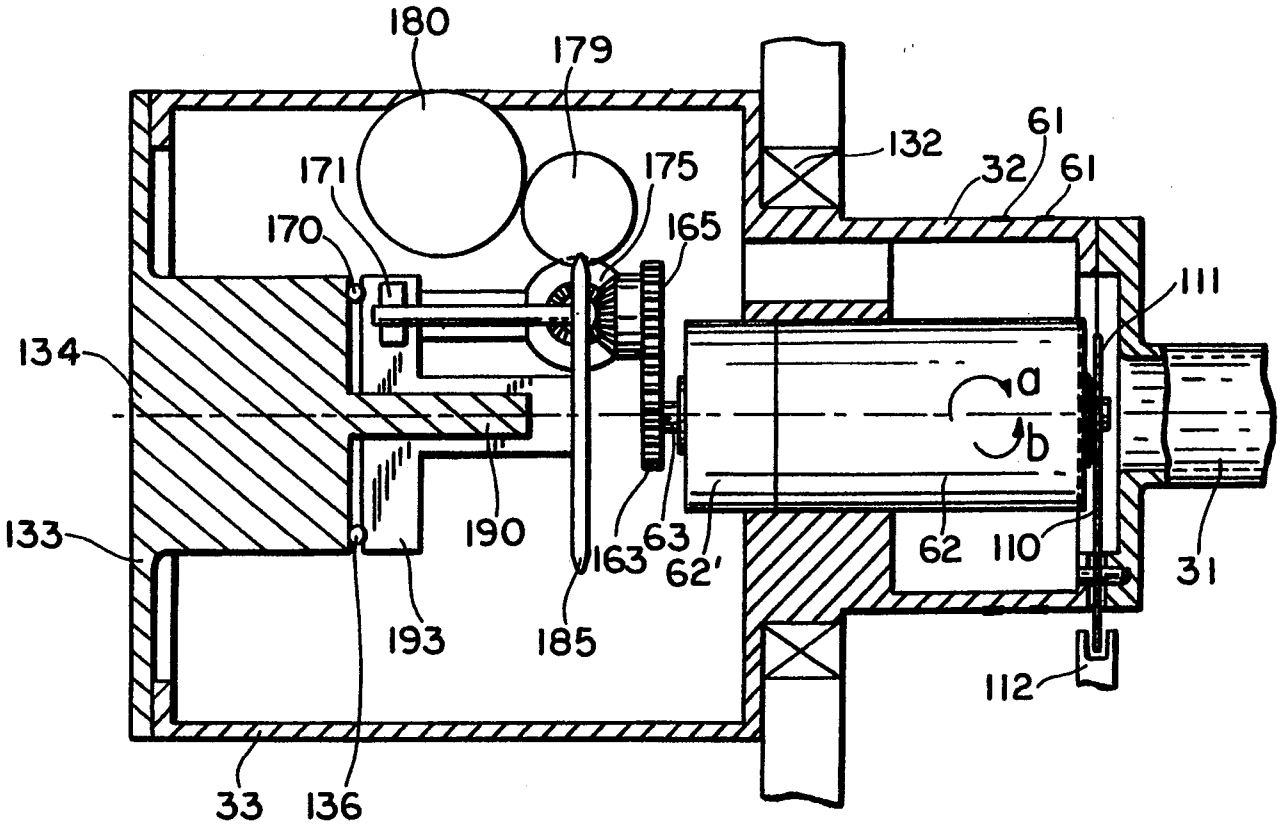
FIG. 5 is a general drawing of the printing rotor in longitudinal section.

FIG. 5 shows a completed general drawing of rotor 26 in central longitudinal section. The rotor cylinder 33 is flange mounted at the unilaterally arranged bearing shaft 31 via bearing area 32. This bearing area has a medium diameter and is rotatably supported in an external bearing 132. It contains in its interior the drive motor 62 to which the step-down gearing 62' and the aforementioned drive shaft 63 are flanged. The motor 62 drives the two double gear wheels 165 and 175, the intermediate gear 179 and number wheel 180 in one rotating direction, a, via the pinion 163. In its other, opposite rotating direction, b, the first double gear wheel 165 is locked by the freewheel bearing 171. As it rotates, the pinion 163 accordingly carries along the disk 185, the bearing plate 193 and the parts supported on the latter. This means that the disk 185 in particular is made to rotate around the axle 190 in the second direction, b, of rotation.

The elements described with reference to FIGS. 4 and 5 can be mounted from the front side 133 of the rotor cylinder 33 and are held by means of the frontal bearing element 134. Ball catch elements 136 between the bearing element 134 and the bearing plate 193 ensure that the disk 185 can be stopped at the correct predetermined angle positions. Disk 185 is arranged in such a way that its bevelled edge engages between two teeth of intermediate gear 179 in each instance. In addition, and at the same time, it must engage correspondingly with the gears and the toothed levers which constitute the gearing areas 55 to 58 of the adjusting elements 45 to 48 (FIG. 3).

Figure 6:
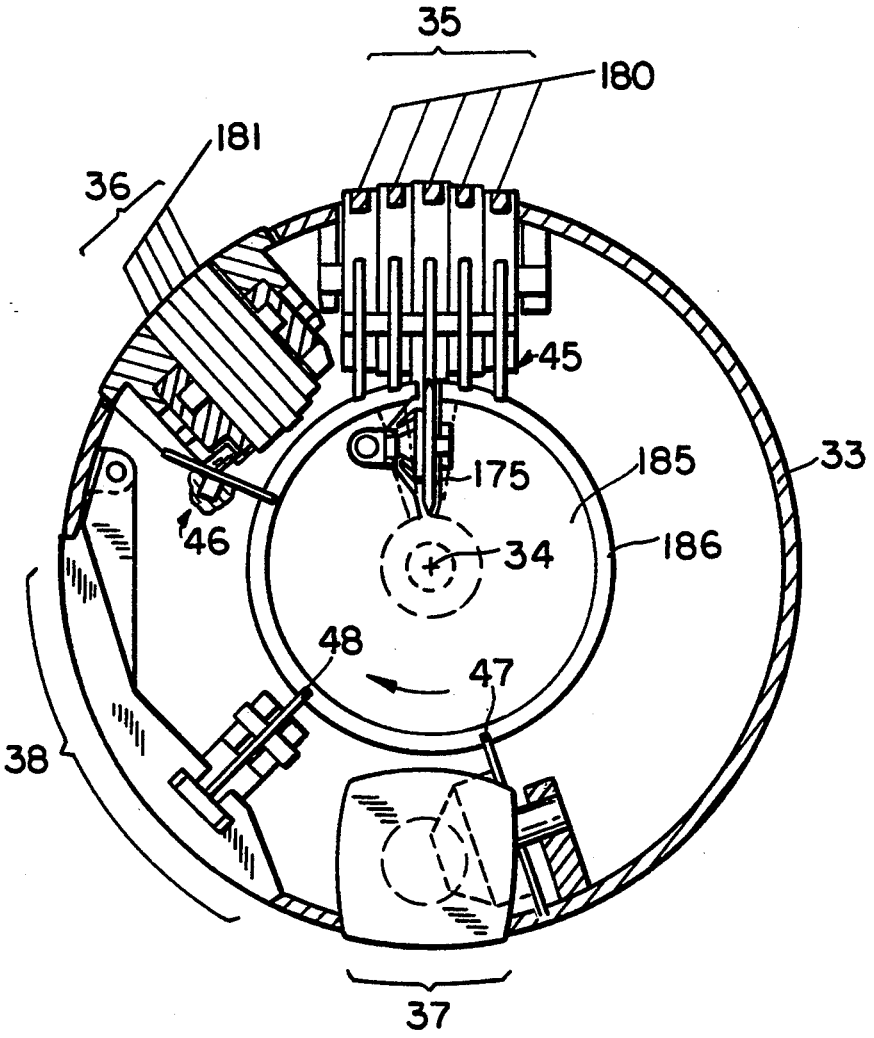
FIG. 6 is a general drawing of the printing rotor in cross section.

FIG. 6 shows a second general drawing in cross section through the rotor cylinder 33, approximately in the plane of disk 185. Disk 185 is centrally supported and its bevelled edge 186 engages with the gearing areas of the adjusting (setting) elements 45 to 48 arranged circularly around the disk 185. The five number wheels 180 of the postage value stamp 35, for example, are mentioned as the first of these adjusting elements. The middle one of these wheels 180 is presently engaged, via its assigned intermediate gear, with the second double gear wheel 175. The other adjusting elements shown are the date stamp 36 with five adjustable date number wheels 181, the advertizing stamp 37, which can be lowered, and the postal identification stamp 38.

The number wheels 180 of the postage value stamp 35 with their printing areas, indicated in black, lie along the outer circumference of the rotor cylinder 33. Since their own dimensions are uniform, they cannot be mounted on a common, linear axis (as shown in FIG. 6). This axis must rather be curved or have steps corresponding to the required curvature. In addition, it is necessary to ensure that the gearing areas of number wheels 180 cooperate with the outer circle or edge 186 of the disk 185. This can be achieved by means of helical gearing. The same naturally also applies in a corresponding manner to the number wheels 181 of the date stamp 36.

The arrangement described thus far operates as follows: Prior to use, the rotor 26 and the disk 185 are in their starting positions and the number wheels 180 of the postage value stamp 35 are at zero. As soon as a letter is to be stamped, the user of the postage meter machine 19 enters the required postage amount into the machine via the keyboard 20. This amount, e.g. 4 guilders, 75 cents, appears in the control unit 75 which, via control switch 79, sets the drive motor in motion in the second rotating direction b. When the motor is turning in this rotating direction b, double gear wheels 165, 175 are blocked by the freewheel bearing 171 as was described. Consequently, disk 185 turns in a clockwise direction and causes the second double gear wheel 175 to engage with the intermediate gear 179 of the first number wheel 180 of the postage value stamp 35, which number wheel 180 is responsible for the smallest value. When the disk 185 is in this position, the drive motor 62 reverses direction. This releases the freewheel bearing 171 and the disk 185 positions itself exactly due to the elastic force of the ball catch element 136. The drive motor 62 now rotates in its first rotating direction a, and in so doing takes with it the two double gear wheels 165, 175 and, via intermediate gear 179, adjusts the number wheel 180 to position 5 corresponding to 5 cents.

By briefly reversing the motor 62 into the second rotating direction b, the second double gear wheel 175 engages with the intermediate gear 179 of the second number wheel 180 of the postage and value stamp 35 and, with the motor turning in rotating direction a, this number wheel is then adjusted to position 7, corresponding to 70 cents.

By reversing the motor 62 into the second rotating direction b, the second double gear wheel 175 is engaged with the intermediate gear 179 of the third number wheel 180 of the postage value stamp 35 and, when the direction of rotation is again reversed to direction a, this number wheel is adjusted to position 4 corresponding to 4 guilders. This concludes the postage setting for value stamp 35 and with the motor again turning in rotating direction b, disk 185 returns to its starting position.

During the setting operation, rotation sensor 83 monitors the rotation of motor 62 in the two rotating directions a and b. Parallel to this, the setting sensor 81 monitors the adjustment of the number wheels 180 and their final position. The results of the monitoring are continuously reported back to control unit 75, so that the latter is constantly informed about the execution of its control commands.

As soon as the setting operation has been properly completed, the adjusted postage amount appears on the display of the keyboard and display unit 20 of the postage meter machine. This enables the user to perform a visual check. It also signals that the stamping operation can now take place, e.g. by introducing the letter to be stamped into the postage meter machine 19. The rotor control 73 accordingly receives its start command, the rotor drive motor 72 begins to rotate and effects a single, full revolution of the rotor cylinder 33. The printing areas 35' to 38' of the stamps 35 to 38 are inked and roll over the letter, thereby transferring the ink to the letter in the form of a stamp imprint. At the same time, the adjusted postage amount of 4 guilders, 75 cents is registered in the meter amount storage 24.

By repeating the start command to rotor control 73, the next letter can immediately be metered with the same postage amount. If on the other hand a different amount is to be used, number wheels 180 of the postage value stamp 35 must be reset to the new amount, analogously to the setting process described above.

The setting process can only be effected when the rotor 26 is in the rest position. This requirement can be satisfied, for example, in that the contacts 61 for the power supply to the drive motor 62 are designed in point form, rather than spread out annularly over the entire circumference of its bearing area 32. In this case, contact will occur only when the rotor 26 is at the angle corresponding to the rest position.

If the setting of the date stamp 36 is to be changed, the corresponding input is also effected in this case via the keyboard of the unit 20 and the control unit 75 controls the disk 185 and the number wheels 181 to the assigned angle positions in a manner analogous to the process described above for inputting the postage value. The same applies to the lowering or placing-in-position of the advertizing stamp 38 and the other stamps 37. In this case also, the drive motor 62 rotates alternately in its two rotating directions b and a, thereby bringing the disk 185 into the desired angle position and accordingly causing the double gear wheel 175 to engage with the assigned adjusting element 48 or 47. Because of its function, the second double gear wheel 175 can also be referred to as a coupling gear.

Control unit 75 is preferably designed in such a way that it stores the information contained in it such that the information cannot be lost. In particular, the information is not lost when the postage meter machine 19 is switched off. Data concerning the respective angular position of the disk 185 and all number wheels 180, 181, as well as the position of the advertizing stamp 38 and other stamps 37, is contained in the control 75 in suitable form as constantly changing information. It comprises, e.g., information concerning the number of revolutions of drive shaft 63 required to go from every position to every other position as permanently stored data.

Rotation sensor 83 is designed, for example, as a clock disk 110 which is mechanically coupled with the drive motor 62 via an intermediate gear 111 (FIG. 5). A light barrier 112, which is formed, e.g., in a U-shaped manner, scans clock disk 110 in such a way that not only the number of revolutions of drive shaft 63 are determined, but also the respective rotating direction a, b.

Setting sensor 81 also works in a contactless manner, particularly magnetically. For this purpose, number wheels 180 of the value stamp 35 are magnetically coded; at least the zero position is magnetically marked.

Control switch 79 is a semiconductor switch which allows the drive motor 62 to be switched from forward to reverse. If the motor 62 is a DC motor, this means that the polarity of the current direction must be reversed. If the motor 62 is a step motor, the control switch 79 is a complicated motor control switch, but one which is known per se.

The embodiment example for a rotor unit 25 described with reference to FIGS. 4 to 6 is based on a general construction principle with the following features:

- A drive shaft 63 which can rotate in both rotating directions is located in the interior of the rotor 26.
- Drive shaft 63 is driven by a motor 62 either directly or via a step-down gearing 62', wherein a control arrangement 75, 79 controls the motor 62.
- There is a primary means in the interior of rotor 26 by which drive shaft 63 is mechanically coupled with a single number wheel (e.g. 180) in each instance or with a single gearing area 55–58 in each instance, respectively.
- There are secondary means which mechanically couple the drive shaft 63 with the respective selected number wheel (e.g. 180) or with the selected gearing area 55 to 58, respectively, in such a way that one setting, e.g. of a number in the printing position, can be effected.
- There are tertiary means which lock all those number wheels or gearing areas 55–58, adjusting elements 45–48 and printing elements 35'–38' which are not being adjusted at that particular time.
- The primary and secondary means comprise a clutch arrangement 64 which couples the primary or secondary means with the shaft 63, depending on the direction of rotation a, b of the drive shaft 63.
- The tertiary means are centrally symmetrical, preferably in the form of a disk 185, and are in contact with the primary and secondary means.

The following variants of the actual construction can be derived from the preceding general construction principle:

- Clutch arrangement 64 was described with reference to FIGS. 4 and 5 as a device having a (single) freewheel bearing 171. This is a first embodiment form, however, the clutch arrangement can also be constructed as a self-switching change gear or the like.

Figure 7:
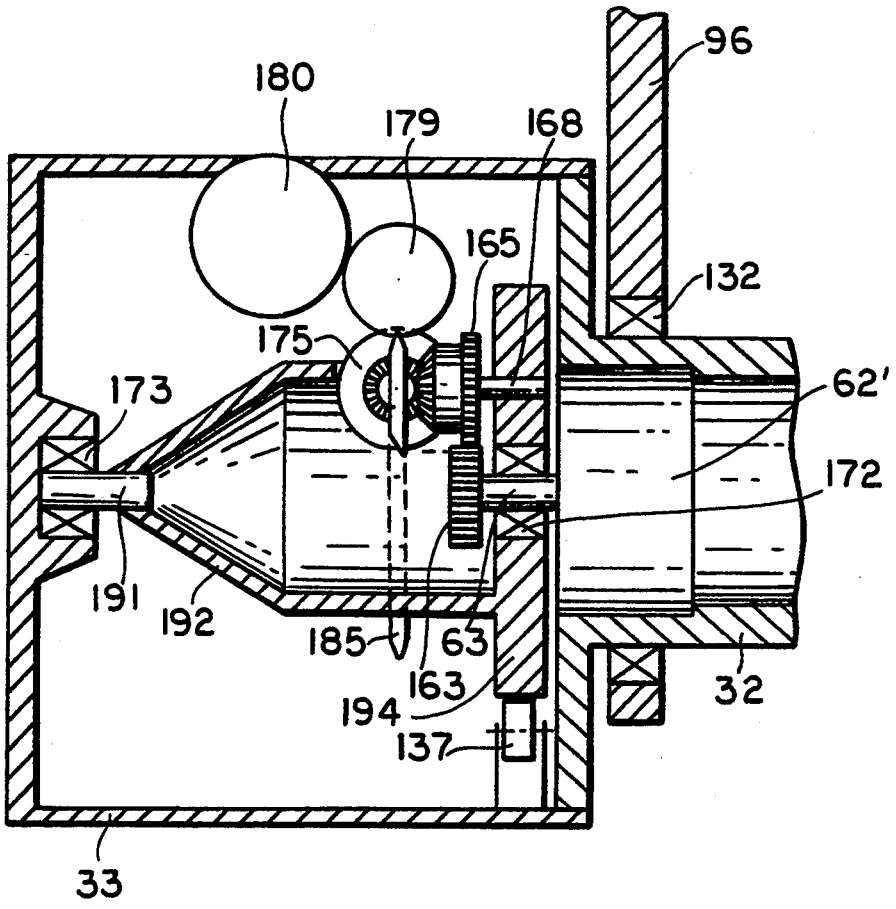
FIG. 7 illustrates an alternative to the printing rotor corresponding to FIG. 5.

FIG. 7 shows a variant of FIG. 5 with two freewheel bearings 172, 173, which is suitable for manufacturing by means of the plastic injection molding technique. A support 192 which is symmetrical with respect to rotation and comprises disk 185 in the form of a collar is located inside rotor cylinder 33. On the side facing the bearing area 32, the support 192 comprises a (second) support plate 194. The two double gear wheels 165 and 175 are arranged on support 192, first double gear wheel 165 being supported on an axle pin 168 which is pressed into support plate 194.

Support 192 is supported on the two freewheel bearings 172 and 173, one of which blocks in right-handed rotation and the other in left-handed rotation. The bearing 172 is attached to drive shaft 63 which proceeds from the step-down gearing 62' and carries the pinion 163. The other freewheel bearing 173 is arranged between a power take-off shaft 191 of support 192 and a bearing area of rotor cylinder 33. Support 192 is accordingly supported at both sides and, depending on rotating direction b, a of drive shaft 63, is connected at a rigid angle either with drive shaft 63 or with rotor cylinder 33.

Grooves on the front side of support plate 194, in which a spring-mounted roller 137 engages, serve to position support 192 at precisely the right angle.

Disk 185, with its tapered edge 186, and the respective tooth of the drive wheel 175 together engage in gearing areas 55 to 58 of all adjusting elements 45 to 48 and lock them in their respective positions. The angular position of disk 185 itself is unimportant in this regard. Thus, disk 185 represents a very elegant solution for the aforementioned tertiary means. Alternatively, instead of a planar disk, it is also possible to use a cup-shaped element having a cylindrical or conical wall or other circularly symmetrical form. Other solutions are also possible, e.g. in that the adjusting elements 45 to 48 are generally provided with a locking position for every stable position.

Drive shaft 63, as shown in FIGS. 4 and 5, is a component part of step-down gearing 62' arranged inside rotor cylinder 33, step-down gearing 62' being directly flanged to drive motor 62. Shaft 63 further lies in geometrical axis 34 of the rotor cylinder 33.

Figure 8:
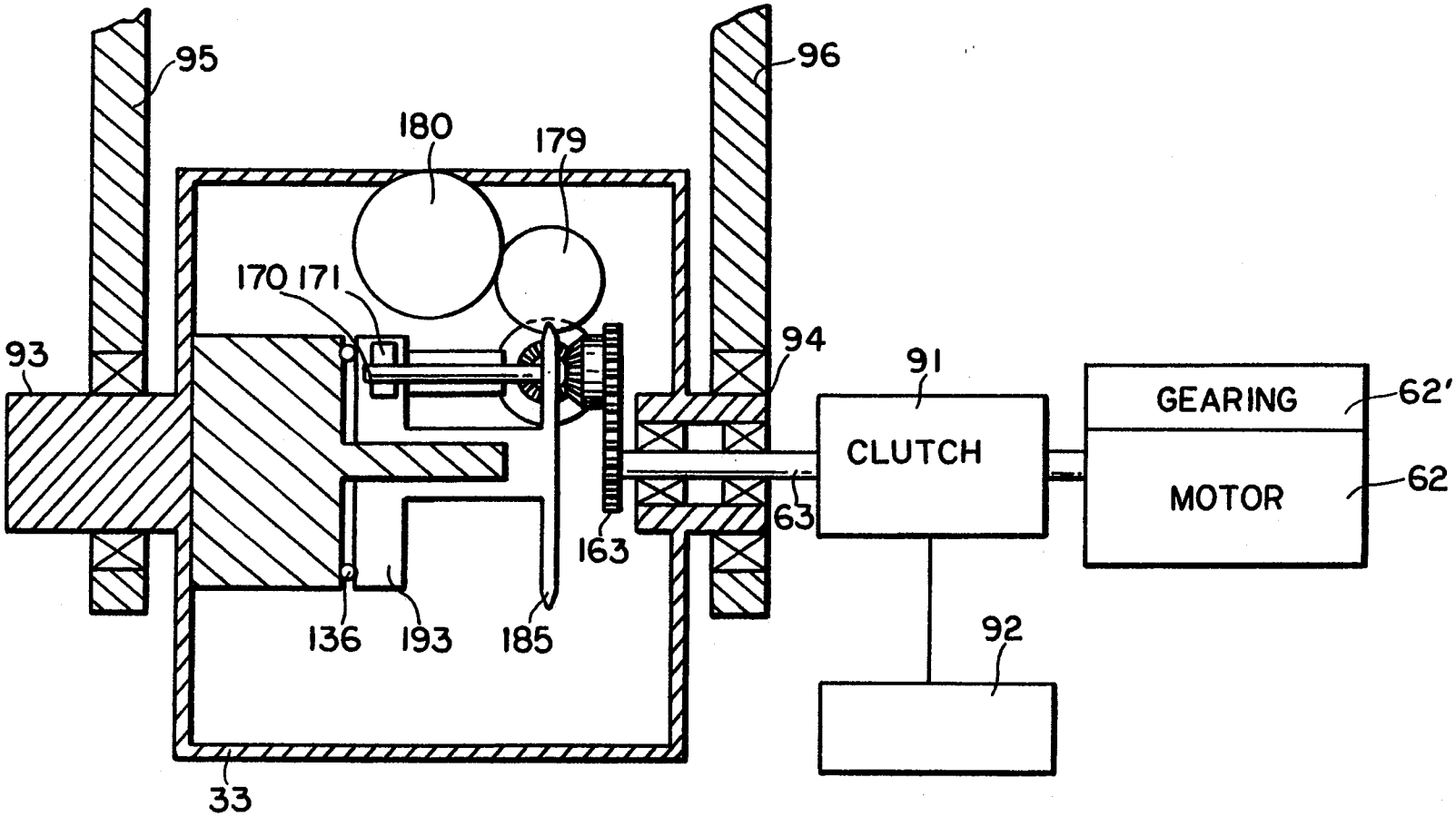
FIG. 8 illustrates a longitudinal section through a second rotor unit.

FIG. 8 shows a variant of the preceding embodiment. In this variant, shaft 63 projects axially and rotatably from rotor cylinder 33 and is detachably connected with drive motor 62 which is fixed outside rotor 33, or with its step-down gearing 62', via an electrically actuated clutch 91, e.g. a magnetic clutch. Clutch 91 accordingly connects drive shaft 63 with motor 62 only when adjustment is to be carried out. In particular, when rotor cylinder 33 rotates the clutch is disengaged. A substantial disadvantage of this variant consists in that a control logic 92 must be provided for controlling the clutch 91, which involves a substantial expense. It is advantageous that motor 62 is not operated via sliding contacts 61 (FIGS. 3 and 5).

Figure 9:
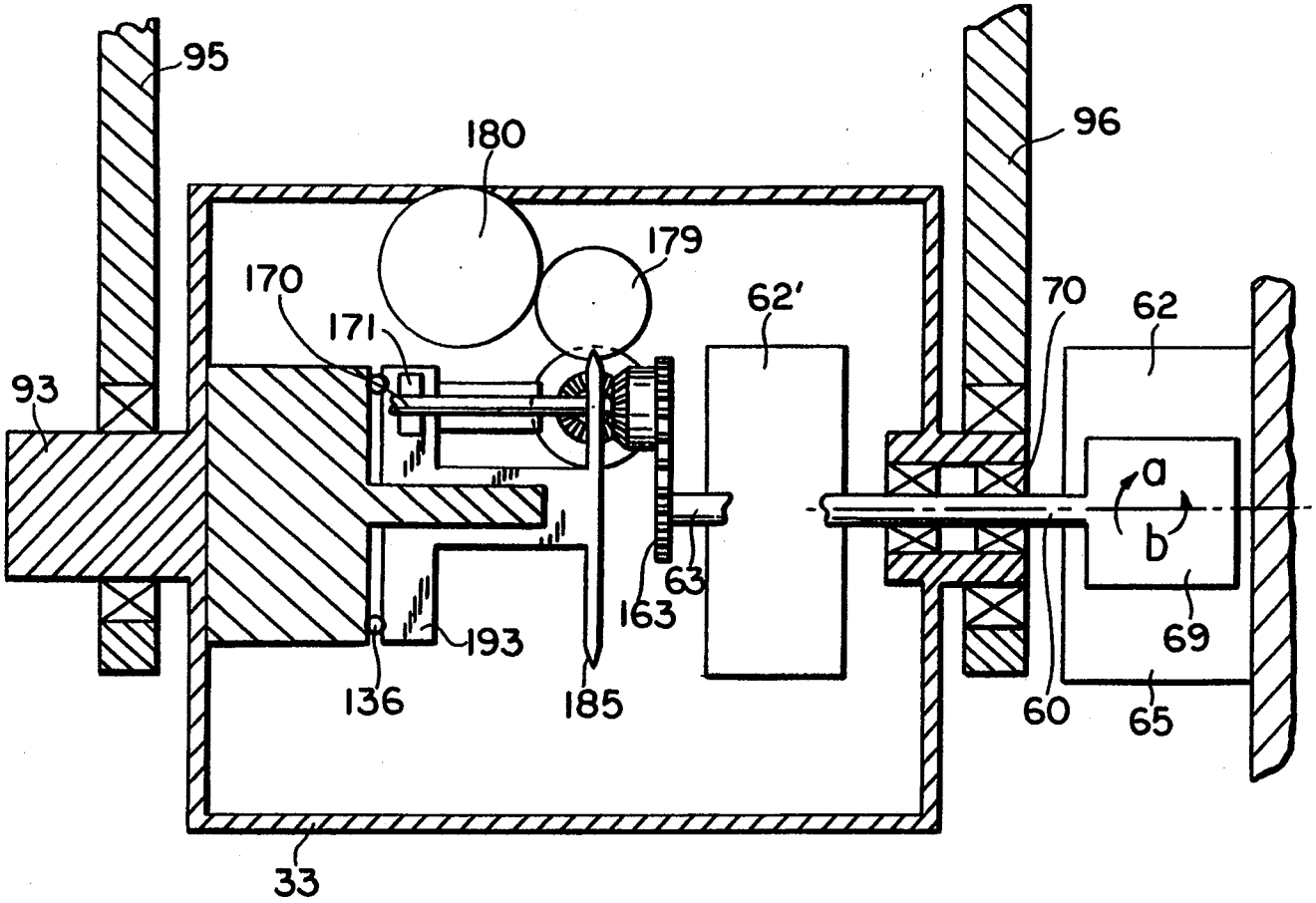
FIG. 9 illustrates a longitudinal section through a third rotor unit.

The aforementioned disadvantage can be overcome in a very simple manner, corresponding to FIG. 9, by separating motor 62 and assigned step-down gearing 62'. The step-down gearing 62' is arranged inside rotor cylinder 33 in such a way that it is rigidly connected with the latter 33. Drive motor 62 on the other hand is fixed in place outside rotor cylinder 33. Motor 62 and gearing 62' are connected via a connecting shaft 60 which may be as long as desired. Connecting shaft 60 is centrally supported in rotor cylinder 33 in a bearing 70.

In order to set the stamps 35 to 38, motor rotor 69 rotates alternately in the two rotating directions a, b, as described above, while rotor cylinder 33 remains stationary and in so doing drives, via its shaft 60, the toothed wheels of step-down gearing 62' and finally shaft 63 and the other adjusting means. If on the other hand rotor cylinder 33 is rotating for the purpose of imprinting with the stamps, the adjusting means are locked as described, e.g. by means of ball catch elements 136. This locking also acts on the toothed wheels of the step-down gearing 62' and the motor rotor 69. The latter 69 therefore rotates together with rotor cylinder 33 relative to stationary motor stator 65, making exactly one rotation around its own axis. This is a very slow rotation for motor 62 and is completely unproblematic. The electrical voltage induced in the motor stator 65 by this rotation can be readily eliminated electrically, e.g. by means of a resistance short-circuited to the motor winding.

In this latter variant, the separation line between the parts of rotor unit 25 which rotate along with rotor cylinder 33 and the parts which are stationary extends between motor rotor 69 and motor stator 65 of drive motor 62. This is a natural separation line and is thus very advantageous.

FIGS. 8 and 9 further show that rotor cylinder 33 is supported at both sides via two axles 93, 94 in two U-shaped support legs 95, 96 arranged from above. The surface under the rotor cylinder 33 remains free as before in order to allow the passage of letters to be stamped. The support at both sides, however, can have considerable structural advantages over the previous conventional support on one side.

In addition to the variants described above, rotor unit 25 allows a considerable number of further variants, some of which are mentioned in the following:

Drive shaft 63 can be arranged centrically relative to rotor axis 34, parallel to it or in any other direction.

The connecting means between drive shaft 63 and adjusting elements 45 to 48 can comprise toothed wheels, gear units, axles, etc. as desired.

In conformity with the previous support at one side via the relatively long shaft 31 (FIG. 5), the spatial separation between motor 62 and step-down gearing 62' may be considerable. In this case, a correspondingly long shaft must be used as motor shaft 60, e.g., a cardan shaft or a flexible shaft to compensate for parallax errors.

It is further possible to assign a small portion of the step-down gearing 62' directly to motor 62, e.g., a preliminary step-down of 1:2. In this case, the number of rotations of motor rotor 69 increases in a corresponding manner with the rotation of rotor cylinder 33. In every case, however, the major portion of the step-down gearing 62' should be arranged in rotor cylinder 33.

If motor 62 has a motor shaft 60 which projects out of housing and the stator 65 on both sides, any type of shaft encoder which replaces the arrangement of clock disk 110, intermediate gear 111 and light barrier 112 (FIG. 5) can be readily arranged on the side of motor 62 opposite shaft 67.

Variants with regard to drive motor 62, clutch arrangement 64 and the support of rotor cylinder 33 were already mentioned in the preceding. In particular, the use of a step motor is possible.

In order to supply power to a drive motor 62 arranged inside rotor cylinder 33 (FIGS. 3 and 5), point form contacts 61 or annular contacts may be used, as mentioned above. The latter may be arranged orthogonally or parallel to rotor axis 34. The latter case will result in contacts which are arranged at the front and can be realized e.g. as wear-resistant mercury contacts.

There are no restrictions as to materials. Therefore, rotor unit 25 may be made of metal as well as of plastic.

In all the variants described here, stamps 35 to 38 are adjusted serially in a plurality of steps which are continuously monitored. Each adjusting operation may generally begin from a predetermined zero position. This requires a return to this zero position after each adjusting operation. Alternately, each adjusting operation may begin from the end state of the respective preceding adjustment, which presupposes continual knowledge of this respective position.

Overall, the advantages of rotor unit 25 are as follows:

It has fewer parts than prior conventional rotor units and is accordingly less costly to produce.

For the same reason, it can be made smaller, which reduces the moment of inertia so that rotor drive motor 72 and the bearing 132 can also have a less robust construction, which further reduces the cost. This also results in a saving of space as a whole which can thus be used for other purposes.

It does not require a long, unilateral axle as do prior conventional rotor units; rather, it can be supported in any desired manner, particularly at both sides.

Its construction is electronic to a considerable degree and it is therefore more in keeping with contemporary production trends than prior conventional rotor units.

All stamps 35 to 38 can be adjusted by actuating the keyboard 20 and it is accordingly easy to operate and up to date. Further, every adjustment may be externally program-controlled or automated.

Accordingly, rotor unit 25 as a whole forms a very progressive and advantageous solution for a long-known construction group of postage meter machines. It can be produced economically and enables easier operation of the postage meter machine.

While the foregoing description and drawings represent the preferred embodiments of the present invention, it will be obvious to those skilled in the art that various changes and modifications may be made therein without departing from the true spirit and scope of the present invention.

We claim:

1. A rotor unit for a postage meter machine comprising:

a rotatably supported rotor cylinder;

at least one stamp arranged at rotor cylinder, a plurality of adjustable number wheels being assigned to the stamps;

setting elements which can be mechanically coupled to the number wheels and by means of which these wheels can be adjusted according to requirements of a user;

a drive shaft which is rotatable in both directions (a, b) of rotation and which cooperates with the adjusting elements;

a drive motor which drives drive shaft;

locking means which lock all number wheels in their respective position whose setting is not to be changed at the particular time; and connecting means which, depending on the direction (a, b) of rotation of said drive shaft, act in such a way that this drive shaft can be coupled with any desired number wheel when rotating in direction (b) and a coupled number wheel can be brought into a desired setting position when the shaft rotates in the other rotating direction (a).

2. A rotor unit according to claim 1, wherein said connecting means comprises at least a freewheel bearing and a shaft, which is supported in said bearing, in such a way that each freewheel bearing rigidly locks with the shaft supported in it when this shaft rotates in a predetermined direction.

3. A rotor unit according to claim 2, wherein a single freewheel bearing is provided, and wherein locking elements are provided, those positions in which the drive shaft are coupled with a number wheel being assigned to the locking positions of the locking elements.

4. A rotor unit according to claim 3, wherein two freewheel bearings are provided, one of which locks with the respective assigned shaft in one rotating direction (b) of said drive shaft, while the other does so in the other rotating direction (a) of drive shaft.

5. A rotor unit according to claim 1, wherein a rotatably supported disk is provided as the locking means, in that means comprises a toothed wheel which is arranged at the disk in such a way that always one of its radial teeth completes a part of the disk edge in each instance, and wherein intermediate gears engage with the number wheels and which are circularly arranged in such a way that the edge of the disk and the respective radial tooth together engage between two teeth in each instance in each of the number wheels.

6. A rotor unit according to claim 5, wherein a bearing plate is provided which is arranged parallel to said disk and is rigidly connected with it, and wherein the freewheel bearing is arranged on said bearing plate.

7. A rotor according to claim 4 or claim 5, wherein a rotatable support is provided which integrally surrounds said disk, and wherein the support is mounted in said two freewheel bearings.

8. A rotor unit according to claim 1 wherein said drive motor can be operated in either of two rotating directions, as desired, said motor being controlled by an assigned control unit.

9. A rotor unit according to claim 8 wherein said drive motor and an associated step-down gearing are arranged inside said rotor cylinder and are linked with said rotor cylinder, and wherein said drive shaft is the take-off shaft of said step-down gearing.

10. A rotor unit according to claim 8 wherein said drive motor and associated step-down gearing are fixed outside said rotor cylinder, and wherein said drive shaft leads through the wall of rotor cylinder centrically relative to the axis of the latter, and wherein a controllable clutch is provided which is arranged between the gearing and drive shaft.

11. A rotor unit according to claim 1, wherein said drive motor is fixed outside rotor cylinder, wherein associated step-down gearing is arranged in the interior of said rotor cylinder and is connected with said rotor cylinder, and wherein a connecting shaft is provided which leads through the wall of rotor cylinder centrically to its axis and which connects said motor rotor of said drive motor and said step-down gearing with one another.

* * * * *